US006213133B1

(12) United States Patent
Reicks

(10) Patent No.: US 6,213,133 B1
(45) Date of Patent: Apr. 10, 2001

(54) METHOD AND APPARATUS FOR FLUSHING CONTAMINANTS FROM OIL IN AN OIL COOLER

(76) Inventor: Dan Reicks, 2588 120th St., New Hampton, IA (US) 50659

( * ) Notice: Subject to any disclaimer, the term of this patent is extended or adjusted under 35 U.S.C. 154(b) by 0 days.

(21) Appl. No.: 09/204,133

(22) Filed: Dec. 2, 1998

(51) Int. Cl.[7] ..... B08B 9/00

(52) U.S. Cl. ..... 134/22.1; 134/22.11; 134/22.12; 134/22.18; 134/34; 134/35; 134/37; 134/42; 134/102.2; 134/103.1

(58) Field of Search ..... 134/102.2, 103.1, 134/22.1, 22.11, 22.12, 22.18, 34, 35, 37, 42

(56) References Cited

U.S. PATENT DOCUMENTS

| | | | | |
|---|---|---|---|---|
| 1,906,417 | | 5/1933 | Renfrew et al. . | |
| 2,302,489 | | 11/1942 | Brown | 196/16 |
| 2,425,848 | | 8/1947 | Vawter | 210/62 |
| 2,499,705 | | 3/1950 | Vokes | 184/1.5 |
| 2,635,756 | | 4/1953 | Grieve et al. | 210/52 |
| 3,489,245 | | 1/1970 | Broadwell | 184/1.5 |
| 4,161,979 | * | 7/1979 | Stearns | 134/103.1 |
| 4,217,221 | | 8/1980 | Masso | 210/168 |
| 4,366,003 | * | 12/1982 | Korte et al. | 134/18 |
| 4,390,049 | * | 6/1983 | Albertson | 141/92 |
| 4,645,542 | * | 2/1987 | Scharton et al. | 134/1 |
| 4,971,704 | | 11/1990 | Johnson, Sr. | 210/741 |
| 5,159,956 | * | 11/1992 | Kurihara | 137/624.13 |
| 5,383,481 | * | 1/1995 | Waelput | 134/103.1 |
| 5,443,085 | * | 8/1995 | Huddas | 134/95.1 |
| 5,615,695 | * | 4/1997 | Chambers | 134/102.1 |
| 5,680,877 | * | 10/1997 | Edstrand et al. | 134/103.1 |
| 5,699,817 | * | 12/1997 | Bankert et al. | 134/102.2 |
| 5,706,841 | * | 1/1998 | Werre et al. | 134/103.1 |

* cited by examiner

*Primary Examiner*—Sharidan Carrillo
(74) *Attorney, Agent, or Firm*—Simmons, Perrine, Albright & Ellwood PLC

(57) ABSTRACT

A contaminant flushing machine for removing contaminants from a container, such as an engine transmission or transmission cooler which includes hoses for coupling to the transmission cooler and a pump for circulating fluid through the hoses and the transmission cooler and a fluid filter having a reduced tendency towards causing vaporization of the fluid. Also included in the contaminant flushing machine is an automatic aeration system for injecting air into the circulating fluid at predetermined intervals. Additionally, a reverse flow piping circuit is included to permit automatic and electric manipulation of the flow direction of fluid through said transmission cooler while at the same time not altering the direction of flow of fluid through the pump.

2 Claims, 5 Drawing Sheets

METHOD AND APPARATUS FOR FLUSHING CONTAMINANTS FROM OIL IN AN OIL COOLER

BACKGROUND OF THE INVENTION

The present invention generally relates to fluid filtering and more particularly relates to a method and apparatus for removing contaminants from a container having petroleum based fluids therein, through a process of circulating, heating and filtering such fluids outside of the container.

In the past, automotive engineers and technicians have been among the many people to recognize the need for an ability to flush contaminants from fluid containing enclosures or systems. One example of such a fluid containing system is a transmission/transmission cooler system in which transmission fluid therein is normally cooled during operation of a vehicle by passing the transmission fluid through the transmission cooler. Such systems frequently contain tiny metal shavings resulting from wear of internal parts. It is desirable to provide an effective way to remove such metal shavings and other contaminants from the system without the need for completely dismantling the transmission and cooling system.

Systems for extracting transmission fluid from the system, then heating it and circulating this fluid through an external filter to thereby flush out contaminants from the transmission and cooling system, have enjoyed considerable success in the past. However, these systems have had several drawbacks. For example, it often takes an extended period of time to heat the fluid to a sufficiently elevated temperature to maximize the removal of contaminants and sediment. This limits the usefulness of such systems, especially for use on vehicles which are generally in revenue generating service. Another problem has often been an undesirable odor which results from circulating heated fluid through a filter. Finally, these systems have often required considerable attention by a trained operator during performance of the flushing operations.

Consequently, there exists a need for improved methods and apparatuses for flushing contaminants from a fluid container.

SUMMARY OF THE INVENTION

It is an object of the present invention to provide enhanced ability to clean contaminants and sediment from a fluid container.

It is a feature of the present invention to include reverse flow switching mechanism in a contaminant flushing apparatus of the present invention.

It is an advantage of the present invention to reduce the effort and complexity involved in reversing a flow direction during the flushing process.

It is another object of the present invention to provide for increased in-field utilization of a flushing system.

It is another feature of the present invention to include a fluid aeration mechanism for reducing the requisite heating time for the fluid.

It is another advantage of the present invention to provide for reduced heating times and, therefore, reduce the overall time required to perform the flushing operation and thereby increase the overall in-field utilization of the flushing equipment of the present invention.

It is yet another object of the present invention to reduce undesirable odors emanating from the flushing equipment.

It is yet another feature of the present invention to include a filtering mechanism which results in reduced vaporization of oil passing therethrough.

It is yet another advantage of the present invention to reduce the undesirable odors associated with vaporization and evaporation of heated petroleum fluids.

The present invention is an improved method and apparatus for removing contaminants from a container having fluids and contaminants therein which is designed to satisfy the aforementioned needs, provide the previously stated objects, include the above-listed features, and achieve the already articulated advantages. The present invention is carried out in a "hands free" operation in the sense that manual manipulation of swapping of hoses between the flushing equipment and the fluid container is eliminated. Instead, this is now accomplished automatically inside the flushing equipment. Additionally, the invention is carried out in an "odorless" system in the sense that much of the undesirable odor of vaporized heated petroleum fluids is reduced.

Accordingly, the present invention is a method and apparatus for flushing contaminants from a fluid container comprising a pump, a fluid heater, and apparatus for injecting air into the fluid.

In an alternate embodiment, the present invention includes a pump, a heater, and a flow direction switching mechanism for reversing the flow of fluid through a container having contaminants therein.

In yet another alternate embodiment, the present invention includes a pump, a heater, and a filter apparatus which is configured to reduce vaporization of heated oil passing therethrough.

BRIEF DESCRIPTION OF THE DRAWINGS

The invention may be more fully understood by reading the following description of preferred embodiments of the invention, in conjunction with the appended drawings wherein.

DETAILED DESCRIPTION

Figure 1:
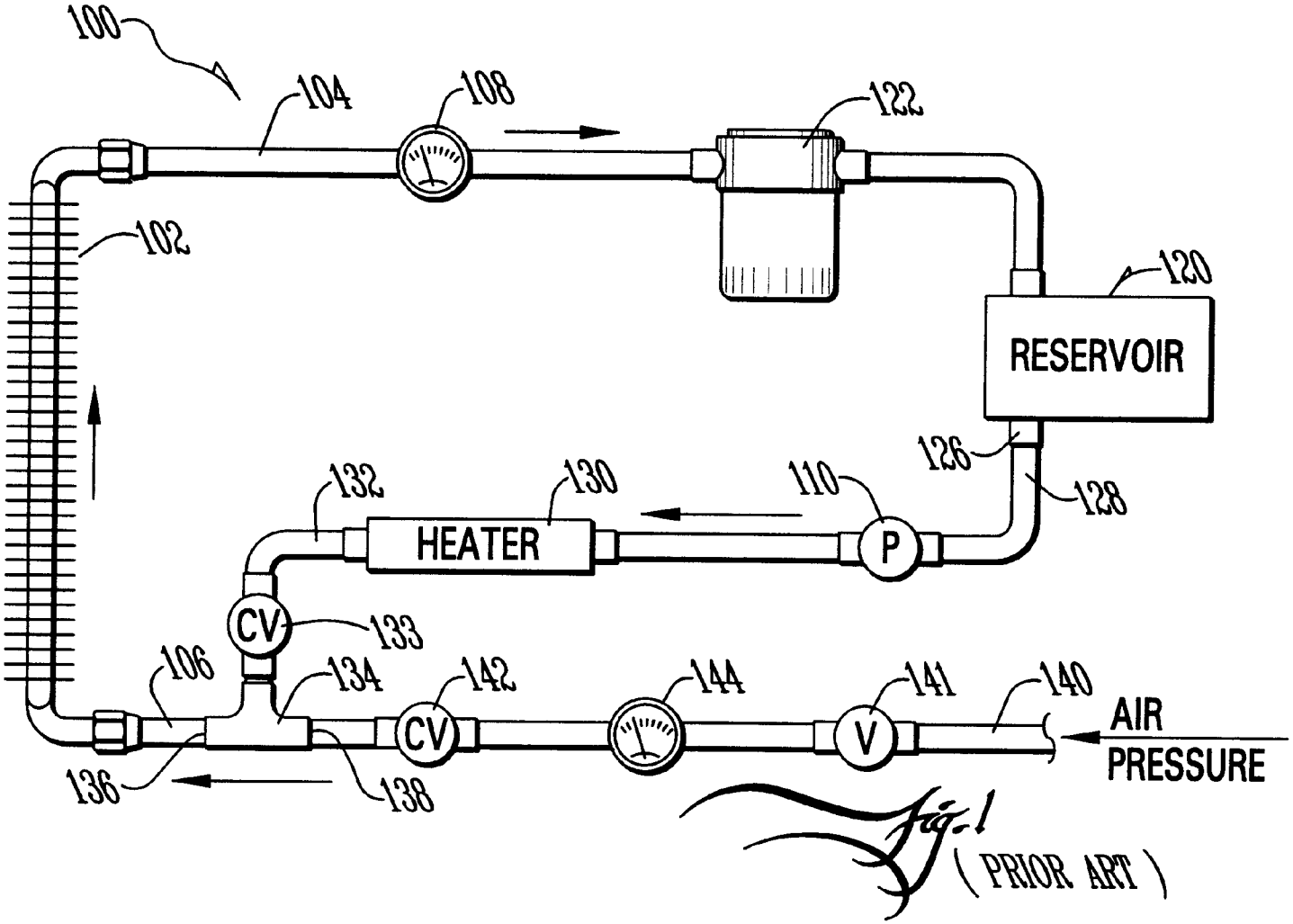
Fig. 1 (PRIOR ART)
FIG. 1 is a simplified diagram showing a prior art contaminant flushing machine.

Now referring to the drawings, wherein like numerals refer to like matter throughout and more particularly to FIG. 1, there is shown a simplified diagram of a prior art contaminant flushing machine, generally designated 100, which is coupled to an automobile transmission cooler 102 by connecting hoses 104 and 106. Hoses 104 and 106 may be special heat resistant hoses or other types. Additionally, hoses may be replaced with pipes, (flexible or not) tubes, or any structure capable of carrying fluid under pressure. Hose 104 is coupled to temperature gauge 108. Also shown is a reservoir 120 which receives transmission fluid from line 104 by first passing such fluid through filter 122. Transmission fluid is disposed in the reservoir which will be extracted through port 126 and line 128 by pump 110. As the transmission fluid is pumped through pump 110 and on to heater 130, it is pressurized and heated to predetermined levels. Exiting from heater 130 is line 132, which is coupled through check valve 133 to T coupling 134, which has an exit port 136, as well as an air cleaning port 138. Air cleaning port 138 is coupled to air line 140, which is available from an air compressor (not shown). Disposed between air line 140 and port 138 is a check valve 142 which prohibits transmission fluid from being exhausted from the system through the air line 140. Additionally, there is shown a pressure gauge 144 for measuring the pressure inside the line 140 and a manual valve 141 for selectively coupling the air line 140 with "T" 134. The purpose of the assembly 134, 138, 140, 142 and 144 is to permit easy purging of any transmission oil left in the lines after the flushing process has been completed. Exit port 136 is directly coupled to line 106, which enters the transmission cooler 102. The terms "lines", "pipes", "hoses", or "tubes" may be used interchangeably herein. They are intended to reflect the many possible structures which could be used to transport fluids.

Figure 2:
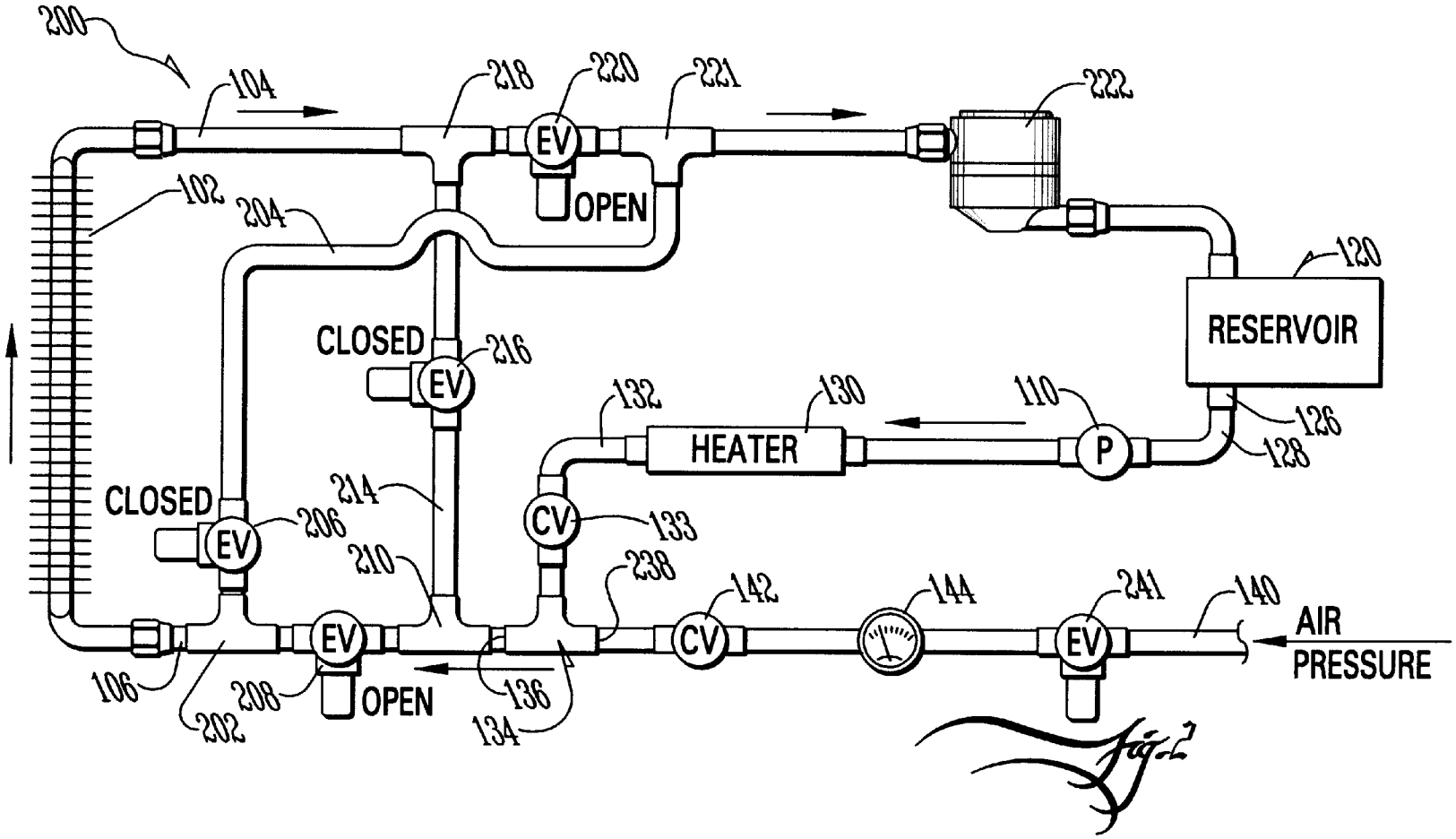
FIG. 2 is a simplified diagram of a contaminant flushing machine, of the present invention, including a reverse flow valve circuit and an automatic aeration control assembly.

Now referring to FIG. 2, there is shown a simplified diagram of a contaminant flushing machine, of the present invention, generally designated 200, which is coupled to an automobile transmission cooler 102 by connecting hoses 104 and 106.

Throughout this disclosure and description, the applicant refers to a transmission cooler, transmission fluid and other examples. These references are merely exemplary of the many different types of fluid containers and fluid types which could be utilized in conjunction with the present invention. For example, the present invention is intended to include and address systems for cleaning engine oil from an internal combustion engine, as well as hydraulic oil from a hydraulic system. Various other systems, fluids and containers are contemplated and could be readily substituted still within the spirit and scope of the present invention. Hose 104 is coupled through T 218, electric valve 220, which may be any electrically operated valve or any suitable substitute, through T 221 and then to vapor retarding filter 222. Also shown is reservoir 120, which receives transmission fluid from line 104 by first passing such fluid through filter 222, which is described in more detail below and shown in more detail in FIG. 4. The transmission fluid is removed from cooler 102 and disposed in reservoir 120, which then is extracted through port 126 and line 128 by pump 110. As the transmission fluid is pumped through pump 110 and on to heater 130, it is pressurized and heated to predetermined levels. Exiting from heater 130 is line 132, which is coupled through check valve 133 to T coupling 134, which has an exit port 136, as well as an aeration port 238. Aeration port 238 is coupled to air line 140, which is available from an air compressor (not shown). Disposed between air line 140 and port 238 is check valve 142, which prohibits transmission fluid from being exhausted from the system through the air line 140. Additionally, there is a pressure gauge 144 for measuring pressure inside the line 140 and an electronic valve 241 for electrically and selectively coupling the air line 140 with the T 134. The purpose of assembly 134, 238, 140, 142, 144, and 241 is to permit regulation of air injection into line 106. Electrical valve 241 is coupled to an electronic control apparatus which is shown and described in more detail below in the text relating to FIG. 5. The oil pumped by pump 110 and passing through heater 130, check valve 133, and T 134 into line 106 progresses in a direction toward cooler 102, but may be diverted from a direct path into cooler 102 by electronic switches 206, 208, 216, and 220 in conjunction with T's 202, 210, 218, and 221, which interconnect lines 104 and 106 and permit an alternate flow direction of oil through cooler 102 depending upon the configurations of switches of valves 206, 208, 216, and 221. When valves 216 and 206 are closed, and valve 208 is open (as shown in FIG. 2), the oil in line 106 will proceed directly into cooler 102 and therethrough to line 104. However, if valve 206 is opened, valve 216 is opened and valves 208 and 220 closed, then oil exiting port 136 of T 134 will pass through T 210 through line 214 through valve 216 through T 218 and then toward cooler 102. Once in cooler 102, it will be able to exit therefrom on line 106 through T 202 and through valve 206 and line 204 to T 221 if valves 208 and 220 are closed. Consequently, by changing the configuration of valves 206, 216, 220, and 208, the flow direction of fluid through cooler 102 can be reversed. Valves 206, 216, 220, and 228 may be an electric coil valve or any suitable substitute which would provide for manipulation of a valve in response to an input electrical signal.

Figure 3:
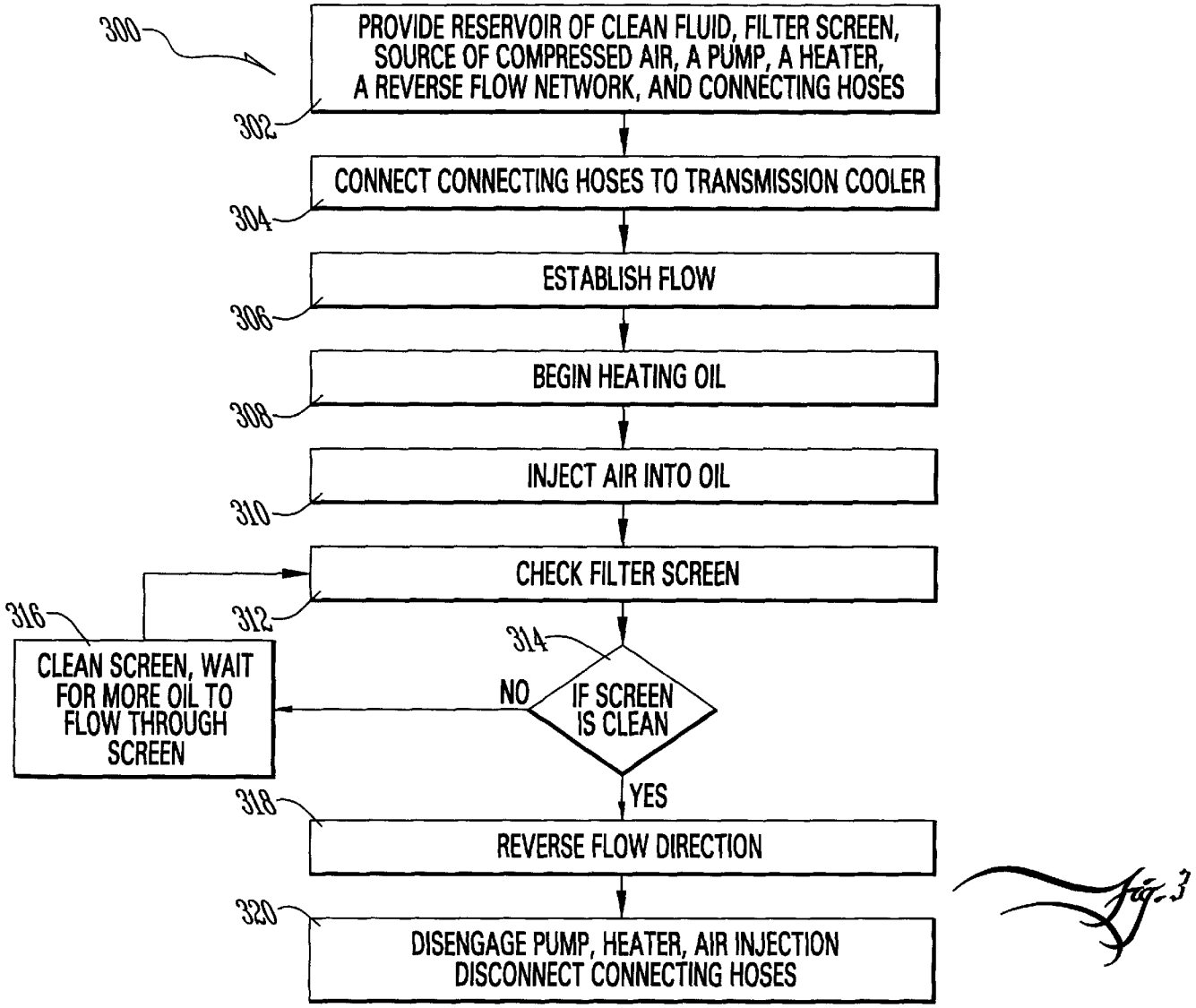
FIG. 3 is a simplified flow diagram of the method of the present invention.

Now referring to FIG. 3, there is shown a simplified flow diagram of the steps of the method of the present invention. FIG. 3 shows one method of the present invention, generally designated 300. The first step 302 is to provide the necessary equipment to perform the service including providing a reservoir of clean fluid, a filtering screen, a source of compressed air, a pump, a heater, a reverse flow network, and connecting hoses. This equipment may be the same equipment as shown in FIG. 2. Step 304 is connecting the equipment to the transmission cooler. Again transmissions, transmission oil, and transmission coolers are used herein as merely a convenient example of the many other uses of the present invention. Step 306 is to establish flow through the equipment by engaging the pump. Step 308 is to begin heating the oil as it passes through the equipment, this is done by engaging the in-line heater. Step 310 is to inject air into the circulating oil. This step 310 may proceed step 308 if desired. The injection of air into the oil may facilitate a more rapid heating of the oil to a desired temperature. The injection of air may be in pulses which could be from three to nine seconds in duration, or other duration. The pulse may last as long as it takes to force all of the oil out of the cooling system and hoses with a very short burst of air at the end. The time between pulses may be between two to three minutes or otherwise. This step of air injection may be automated by the use of electric timers etc. Other means of regulating the cycling of air injection may be used instead of time such as flow volume monitoring and flow pressure monitoring. Step 312 is to check the filter screen to see if contaminants are present. In accordance with decision step 314, if screen is not clean it should be cleaned, in accordance with step 316 and after a wait of a length of time for more oil to pass through the filter screen, step 312 is repeated. If the screen is clean then the direction of flow through the connecting hoses is reversed, in accordance with step 318. This flow reversing step may be automated with the use of timers and electric valves. Depending on the desired level of contamination removal, the steps 312, 314, and 316 can be repeated in the reverse direction. The flow can be then returned to its original direction if so desired. When the desired level of contamination removal has occurred the process can be terminated, in accordance with step 320 and the pump, air injection apparatus and heater disengaged and the hoses disconnected.

Figure 4:
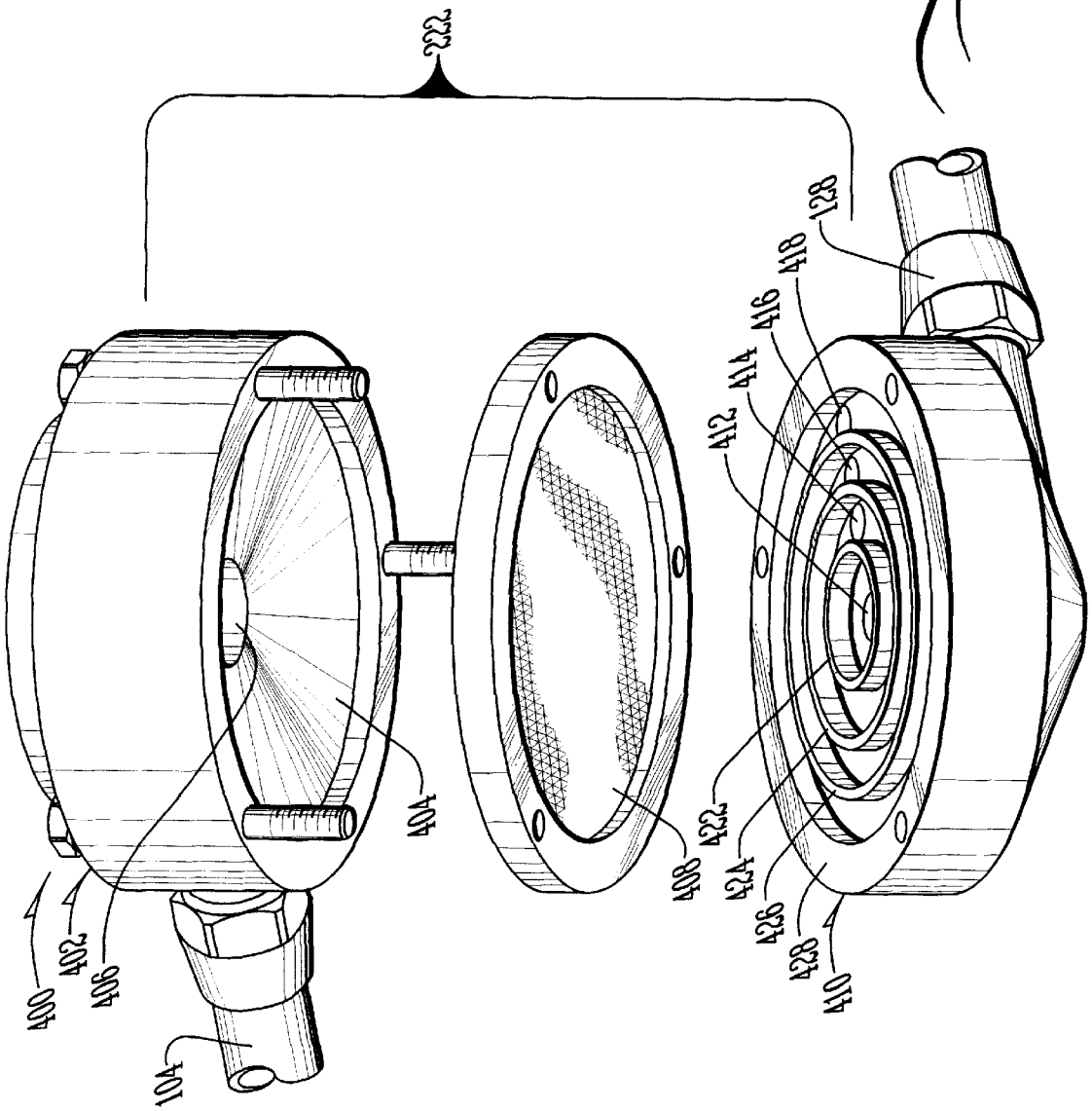
FIG. 4 is an exploded perspective view of the filter 222 of FIG. 2.

Now referring to FIG. 4, there is shown a filter 222 of the present invention, in it intended environment, generally designated 400, which include hose 104. Filter 222 is a preferred filter, but it should be understood that other filters could be substituted in FIG. 2 without depriving the present invention of all of its advantages. Filter 222 is shown having a input line 104 and top section 402 having a top oil dispersing region 404 and an inlet port 406. The size and shape of filter 222, may depend upon particular uses of the system. However, it is believed that having a relatively large and unrestricted oil dispersing region 404 may lead to less vaporization of oil as it encounters the filter 222. The screen 408, is disposed between top 402 and bottom 410. Screen 408 may be any type of filter but a 28 micron filter may be preferred. Bottom 410 is divided in to numerous oil collecting areas which are separated by ridges 422, 424, 426, 428. The areas and their defining ridges have drain holes 412, 414, 416 and 418 respectively disposed therein. The oil enters filter 222, through input port 406, spreads out across the dispersing area 404 and passes through the screen 408. The oil is then collected in the bottom 410 and drains through the drain holes into the reservoir 120.

Figure 5:
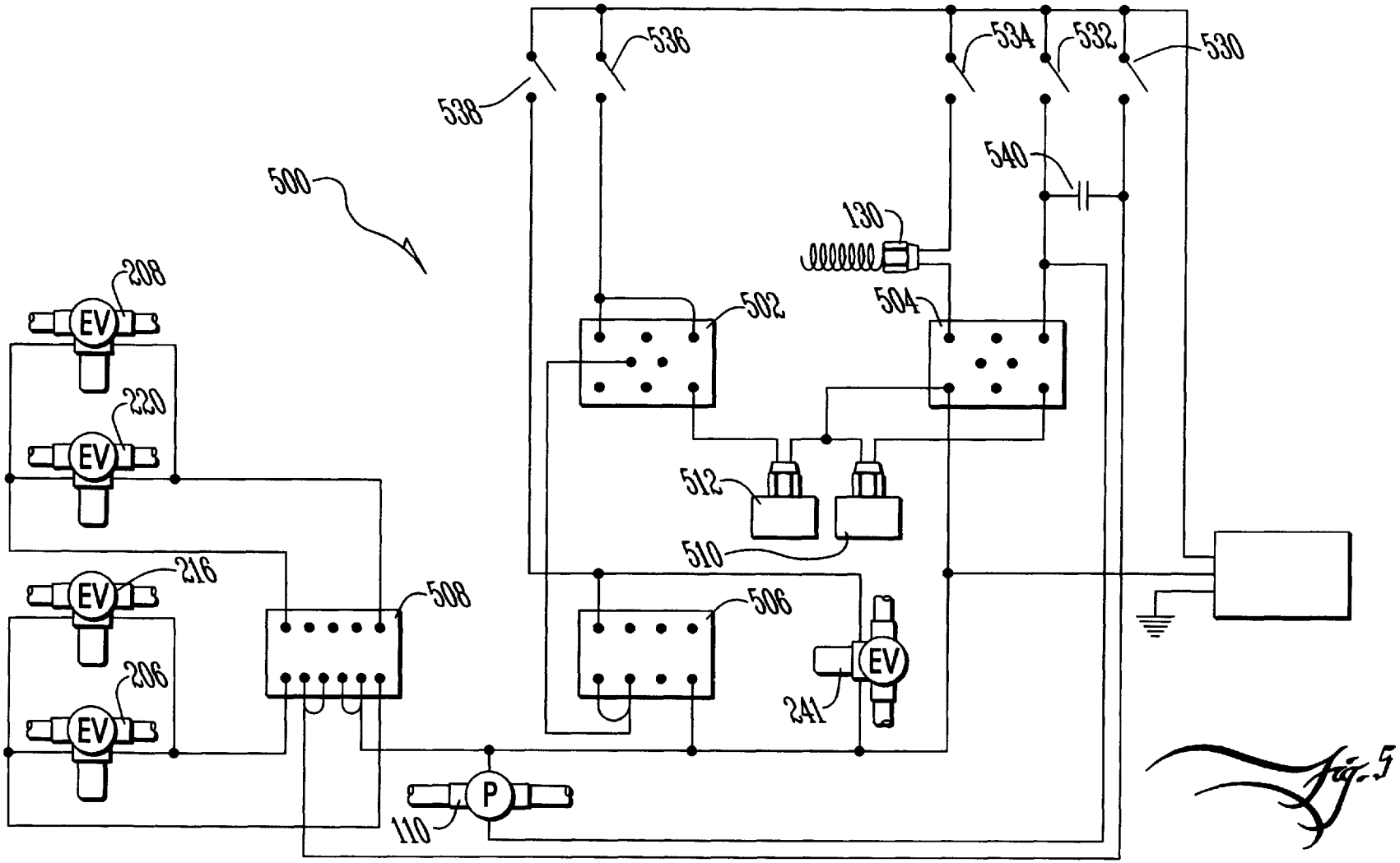
FIG. 5 is an electrical diagram of portions of the present invention.

Now referring to FIG. 5, there is shown an electronic wiring diagram of the present invention, generally, designated 500, which shows a particular wiring arrangement of the present invention. The lines connecting the various points may be insulated electric wires or other conductors. The system include a relay 502 and another relay 504. Also shown is a timer 506 for regulating the air injection process. Timer 506 may be a Dayton 1H3C8F. Also shown is a timer 508 for manipulating the electric valves 208, 206, 216 and 220 used in the network for reversing flow direction. Timer 508 may be a Dayton 6A855. System 500 also includes thermostats 510 and 512. Various other switches and diodes which are individually well known and common in the industry are also shown including reverse flow switch 530, pump switch 532, heater switch 534, auto switch 536, air injection manual override switch 538 and diode 540.

It is thought that the method and apparatus of the present invention will be understood from the foregoing description, and it will be apparent that various changes may be made in the form, construction, steps and arrangement of the parts and steps thereof without departing from the spirit and scope of the invention or sacrificing all other material advantages, the form herein described being merely a preferred or exemplary embodiment thereof.

I claim:

1. A method of removing contaminants from a transmission cooler comprising the steps of:

providing a transmission cooler having transmission fluid therein;

coupling a first hose to said transmission cooler at a first point;

coupling a second hose to said transmission cooler at a second point;

providing a plurality of electrically operated valves between said first hose and said second hose;

providing a pump for circulating said transmission fluid through said first hose, said second hose, and said transmission cooler;

providing a filter exterior of said transmission cooler and between said first point and said second point for collecting contaminants from said transmission fluid;

providing an electrically controlled source of compressed air;

recirculating said transmission fluid through said first hose, said second hose, and said transmission cooler;

heating said transmission fluid;

injecting bursts of compressed air from said electrically controlled source into said transmission fluid at predetermined intervals as said transmission fluid recirculates through said first hose, said second hose, and said transmission cooler;

checking said filter to determine the level of said contaminants present;

determining whether said filter should be cleaned;

cleaning said filter if needed, such that once said filter is cleaned the flow direction of said transmission fluid through said first hose, said second hose, and said transmission cooler is reversed.

2. A method of removing contaminants from an engine oil cooler comprising the steps of:

providing an engine oil cooler having engine oil therein;

coupling a first hose to said engine oil cooler at a first point;

coupling a second hose to said engine oil cooler at a second point;

providing a plurality of electrically operated valves between said first hose and said second hose;

providing a pump for circulating said engine oil through said first hose, said second hose, and said engine oil cooler;

providing a filter exterior of said engine oil cooler and between said first point and said second point for collecting contaminants from said engine oil;

providing an electrically controlled source of compressed air;

recirculating said engine oil through said first hose, said second hose, and said engine oil cooler;

heating said engine oil;

injecting bursts of compressed air from said electrically controlled source into said engine oil at predetermined intervals as said engine oil recirculates through said first hose, said second hose, and said engine oil cooler;

checking said filter to determine the level of said contaminants present;

determining whether said filter should be cleaned;

cleaning said filter if needed, such that once said filter is cleaned the flow direction of said engine oil through said first hose, said second hose, and said engine oil cooler is reversed.

* * * * *